United States Patent [19]

Honjo et al.

[11] 4,011,078

[45] Mar. 8, 1977

[54] PHOTOSENSITIVE MEMBER AND METHOD OF IMAGING

[75] Inventors: Satoru Honjo, Tokyo, Japan
Masamichi Sato, Urbana, Ill.

[73] Assignee: Xerox Corporation, Stamford, Conn.

[22] Filed: Jan. 14, 1972

[21] Appl. No.: 217,845

[52] U.S. Cl. ..... 96/1 R; 96/1 LY; 96/1.5; 96/1.8; 96/67; 96/83

[51] Int. Cl.[2] ..... G03G 13/22

[58] Field of Search ..... 96/83, 67, 38.1, 1 LY, 96/1 R, 6, 1.5

[56] References Cited

UNITED STATES PATENTS

| | | | |
|---|---|---|---|
| 2,041,853 | 5/1936 | Mollo et al. | 96/38.1 X |
| 2,367,551 | 1/1945 | Yule | 96/6 X |
| 2,384,093 | 9/1945 | Holmen | 96/83 |
| 2,398,056 | 4/1946 | Staud | 96/83 |
| 2,409,564 | 10/1946 | Heinecke | 96/83 |
| 2,544,237 | 3/1951 | Reese | 96/83 |
| 2,857,271 | 10/1958 | Sugarman, Jr. | 96/1.8 |
| 3,135,608 | 6/1964 | Dickard | 96/85 |
| 3,183,092 | 5/1965 | Mackey | 96/83 |
| 3,210,187 | 10/1965 | Thommes | 96/83 |
| 3,275,439 | 9/1966 | Battison | 96/67 |
| 3,434,832 | 3/1969 | Joseph et al. | 96/1.5 |
| 3,681,070 | 8/1972 | Timmermaw et al. | 96/1.5 |
| 3,717,461 | 2/1973 | Honjo | 96/1 LY |
| 3,893,854 | 7/1975 | Honjo et al. | 96/1 LY |

*Primary Examiner*—J. Travis Brown
*Attorney, Agent, or Firm*—James J. Ralabate; James P. O'Sullivan; John E. Crowe

[57] ABSTRACT

A novel photosensitive member is disclosed which is suitable for the formation of images on the exterior surfaces of structures such as buildings and ships which comprises a combination of a substrate member and photosensitive layer with both opaque and adhesive layers to provide for attachment of the member to the surface of the structure as well as the imaging thereof under outdoor conditions.

5 Claims, 3 Drawing Figures

PHOTOSENSITIVE MEMBER AND METHOD OF IMAGING

BACKGROUND OF THE INVENTION

This invention relates to xerography, and more specifically to a novel photosensitive member suitable for forming images on outside surfaces.

In the art of xerography, a photosensitive member, such as for example, a paper sheet containing coating of zinc oxide particles contained in an insulating film forming resin is imaged by first uniformly electrostatically charging the surface in the dark. The member is then exposed to a pattern of activating radiation to form a latent electrostatic image on the surface of a binder layer. This latent image may then be developed by immersing the photosensitive member in a liquid developer solution containing toner particles. The toner particles are attracted to, and adhered to the areas containing the latent electrostatic image. After removal from the developer bath, the photosensitive member is dried and the toner image fixed to form a permanent reproduction of the original radiation pattern or image.

In general, the appliction of xerography is not readily adaptable to large outside surfaces such as the sides of buildings or ships, in that the basic xerographic steps enumerated above are somewhat difficult and impractical to perform on outside surfaces. For example, it is impractical to construct large darkroom areas for images of the size contemplated by the instant invention. Similarly, electrical charging units of the size and type required for such applications are impractical due to the economics involved and engineering requirements.

For the above mentioned reasons, a photosensitive member capable of forming images on relatively large outside surfaces would have both novel utility and acceptance in the art.

OBJECTS OF THE INVENTION

It is, therefore, an object of this invention to provide a photosensitive member suitable for use for the imaging on outside surfaces.

It is another object of this invention to provide a photosensitive material which may be used in a novel imaging sequence.

It is another object of this invention to provide a novel photosensitive member.

SUMMARY OF THE INVENTION

The foregoing objects and others are accomplished in accordance with this invention by providing a novel photosensitive material or member suitable for use in forming images on outside surfaces such as the sides of large ships and buildings. The photosensitive member of this invention is characterized by an opaque layer which covers a photosensitive layer contained on a supporting substrate. An adhesive layer is contained at the edges of the interface between the top photosensitive layer and the opaque overcoating. Additionally, the substrate is backed with a uniform adhesive layer.

Imaging is carried out by placing the above member against the side of a large outside object such as the side of a ship such that the adhesive layer backing the substrate is in contact with the surface to be imaged. This is normally carried out in the day under sunlight. When night and darkness comes, the adhesive edging between the photoconductive layer and opaque outer layer is stripped away and image exposure carried out on the photosensitive layer which is now exposed to the environment. The adhesive bonding and opaque layer are then replaced and a developing and fixing solution forced to enter a narrow opening between the opaque top layer and the photosensitive coating. After development and the the developer and fixing solution are removed and the member rinsed with water. This sequence results in the formation of a visible image on the side of the outside surface.

DETAILED DESCRIPTION OF THE INSTANT INVENTION

Figure 1:
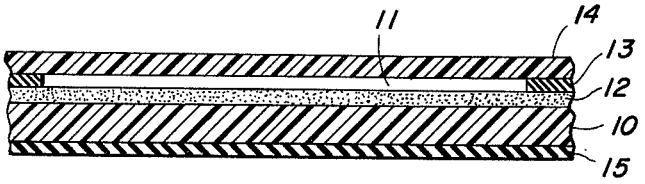
FIG. 1 illustrates a schematic illustration of one embodiment of a photosensitive member of the instant invention.

FIG. 1 is a cross sectional view of the one embodiment of a photosensitive member of the instant invention. In the figure, reference character 10 illustrates an opaque substrate which contains a photosensitive binder layer 12. The binder layer 12 is overlaid with an opaque top layer 14. Adhesive layers 13 and 15 overlay the photosensitive layer at the edges and the complete substrate 10, respectively. It can be seen that with adhesive layer 13 positioned only at the edges of photosensitive layer 12 that a narrow opening 11 is thereby formed between photosensitive layer 12 and opaque top layer 14. The top opaque layer 14, is attached to the photosensitive layer 12 by adhesive layer 13. In an alternative embodiment, layer 12 may be in contact with layer 14, but the embodiment illustrated in FIG. 1 which provides for the narrow opening 11, is preferred. As stated above, adhesive layer 15 is provided at the rear surface of substrate 10. Layers 10 and 14 are opaque with respect to the wavelength sensitive region of photosensitive layer 12.

The opaque substrate 10 should contain any suitable material which is opaque to visible light. Typical materials include polyethylene incorporated with carbon, polyethylene, teraphthalate, polycarbonate, polystyrene, cellulose triacetate, and cellulose acetate butyrate. Alternatively, the substrate may have a multi-layered structure comprising a transparent film coated with an opaque coating. The opaque coating may comprise carbon black blended with resinuous binder, such as nitrocellulose, polyvinyl acetate, vinyl chlorides/vinyl acetate copolymers, or polyvinyl butyral.

The adhesive layers 13 and 15, may comprise any suitable adhesive. Typical adhesives include natural rubber and other additivies such as tackifiers and antioxidizing agents. Suitable materials for the tackifiers include poly (beta-piene), rosin, hydrogenated rosin, glycerol ester of rosin, and xylene/formaldehyde resin.

The opaque top coating 14, may be of the same or a different opaque material as comprises the opaque substrate 10 described above.

Photosensitive material suitable for layer 12 may include any typical silver halide emulsion common to the photography art. Similarly, any photoconductive insulating layer suitable for use in the electrophotography, such as vitreous selenium or photoconductive zinc oxide contained in a film forming insulating resin binder may be employed. Additionally, any other suitable organic or inorganic photoconductor may also be used. It can be seen from the above that both surfaces of the photoconductor are sandwiched by opaque layers. For example, in FIG. 1 opaque layer 14 covers the top of photosensitive layer 12, while the opaque substrate 10 covers the bottom surface of the photosensitive layer 12.

One example of use for the member described above is as follows: The material is placed against the side of an outside object such as a ship or building in the daytime with the adhesive layer 15 in contact with the object to be imaged. An image is then formed by suitable exposure to activating radiation at night under conditions of darkness by stripping off the top adhesive layer 13 and opaque layer 14, and exposing to activating radiation by any suitable method to which the photosensitive material is responsive. For example, if using vitreous selenium as the photosensitive material, exposure to light within the blue-green portion of the spectrum would provide a sufficient latent electrostatic image. The latent image is then developed by techniques well known in the art. Preferably photoconductive materials of this invention are those which obtain an inversible change on exposure, or which keep light-memory for a long time.

Figure 2:
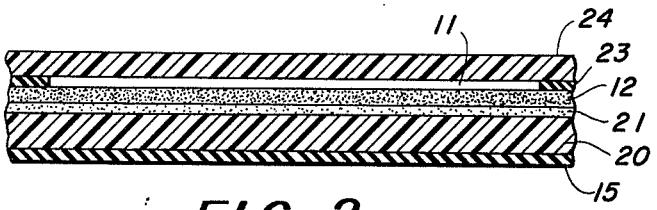
FIG. 2 illustrates a second embodiment of the photosensitive member of the present invention.

FIG. 2 illustrates a cross sectional view of a second embodiment of a photosensitive material of the instant invention. Reference character 20 represents an opaque substrate which supports a light scattering layer 21. The light scattering layer may comprise any suitable film forming binder and white pigment such as for example titanium dioxide, zinc oxide, or barium sulfate. Photosensitive layer 12 overlays light scattering layer 21. Layer 21 would be unnecessary in the case where the photosensitive layer itself is white. Adhesive layer 23 contacts the edges of photosensitive layer 12 forming a thin opening 11 between photosensitive layer 12 and overlaying opaque layer 24. Adhesive layer 15 is contained on the rear side of substrate 20.

Figure 3:
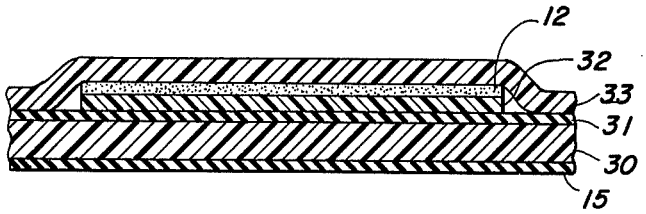
FIG. 3 illustrates a third embodiment of a photosensitive member of the instant invention.

FIG. 3 is a cross sectional view of a third embodiment of the instant invention. In this example, reference character 30 represents an opaque substrate sandwiched by two adhesive layers 31 and 15, respectively. Layer 32 represents a second substrate for a photoconductive layer 12, and need not be opaque. The substrate 32 is attached on first substrate 30 through adhesive layer 31. Opaque layer 32 is attached to first substrate 30 at both ends. The width of photosensitive layer 12 and substrate 32 are smaller than that of the first substrate 30 and opaque layer 33. Adhesive layer 15 is provided at the rear surface of substrate 30. The member described above is utilized and imaged by the same technique described for the members of FIGS. 1 and 2. In this embodiment, the adhesive layer is not always necessary, but is preferred.

Although various modifications and equivalent components have been stated in the above description of the preferred embodiments of this invention, other suitable materials such as those listed above, may also be used with similar results.

Other modifications and ramifications of the present invention would appear to those skilled in the art upon reading the disclosure. These are also intended to be within the scope of this invention.

What is claimed is:

1. A xerographic photosensitive member which comprises an opaque substrate with an adhesive backing on one side and a light sensitive photoconductive insulating layer suitable for use in electrophotography on the other side, said photoconductive layer, in turn, having an opaque overlayer removably attached with an intermediate adhesive layer disposed at the edges between the opaque overlayer and the photoconductive layer resulting in the formation of a narrow opening between said opaque overlayer and said photoconductive layer.

2. The member of claim 1 which further includes a light scattering layer disposed between said photoconductive layer and the opaque substrate.

3. A photosensitive member of claim 1 wherein two substrate layers are utilized in contact through an adhesive layer.

4. A photosensitive member of claim 3 wherein one substrate and the immediately contacting photoconductive layer are smaller that that of the other substrate layer.

5. A method for placing a pattern or image on large external objects comprising placing the photosensitive member of claim 1 against the side of an outside object removing said opaque top layer under darkened or red light conditions, applying an electrostatic charge to the surface of the photoconducitve layer, exposing said charged photoconductive layer to a desired light pattern, within the blue-green portion of the spectrum, developing the resulting non-visible electrostatic image with a xerographic toner, and applying at least one protective light transparent layer over the developed image.

* * * * *